US006718723B1

(12) United States Patent
Al-Tuhami

(10) Patent No.: US 6,718,723 B1
(45) Date of Patent: Apr. 13, 2004

(54) METHOD AND APPARATUS FOR STRENGTHENING THE CONCRETE ELEMENTS USING PRESTRESSING CONFINEMENT

(75) Inventor: Al-Tuhami AbuZeid Al-Tuhami, 9 Al-Hussainia Street, Al-Hussainia, Zagazig, Sharkia (EG), 44519

(73) Assignee: Al-Tuhami AbuZeid Al-Tuhami, Sharkia (EG)

( * ) Notice: Subject to any disclaimer, the term of this patent is extended or adjusted under 35 U.S.C. 154(b) by 0 days.

(21) Appl. No.: 09/420,377

(22) Filed: Oct. 18, 1999

(30) Foreign Application Priority Data

Jan. 9, 1999 (EG) ..... 1999010023

(51) Int. Cl.[7] ..... E04G 21/00
(52) U.S. Cl. ..... 52/745.17; 52/721.4; 264/35
(58) Field of Search ..... 52/745.17, 745.18, 52/721.4, 723.1, 724.5, 736.3, 737.4; 29/897.1; 264/35, 32

(56) References Cited

U.S. PATENT DOCUMENTS 796,227 A * 8/1905 Lally ..... 52/721.4 X
1,804,320 A * 5/1931 Cross ..... 52/721.4 X
3,333,386 A * 8/1967 Lora ..... 52/721.4 X
3,355,852 A * 12/1967 Lally ..... 52/721.5
3,890,794 A * 6/1975 Broadfoot ..... 52/721.4 X
4,071,996 A * 2/1978 Muto et al. ..... 52/721.4 X
4,508,308 A * 4/1985 Rossin et al. ..... 264/35 X
4,604,250 A * 8/1986 Ecker ..... 264/35
6,167,672 B1 * 1/2001 Okitomo ..... 52/721.4
6,219,991 B1 * 4/2001 Salek-Nejad ..... 52/721.4 X
6,247,179 B1 * 6/2001 Murat et al. ..... 52/721.4 X

FOREIGN PATENT DOCUMENTS

JP 4203161 * 7/1992 ..... 52/721.4

* cited by examiner

*Primary Examiner*—Hanh V. Tran

(57) ABSTRACT

A technique and apparatus for retrofitting the concrete elements using external prestressing is presented. The method is more applicable in columns with rectilinear cross-section. This technique increases the strength and ductility of the reinforced concrete elements without significantly increasing the dimensions or weights of these elements, or even harming the concrete section. The technique is simple, easy to use, and does not need special hardware in rectilinear cross-sections. In addition, the technique reduces the lateral strains, internal cracking, and volume increase when adding more loads on the concrete element. Global external prestressing is provided along the whole length or the required part of the element to be strengthened through a set of elongated members using the special apparatus presented hereinafter.

5 Claims, 9 Drawing Sheets

Strengthening Stages of the Reinforced Concrete Column Using Pressure Casing 1.

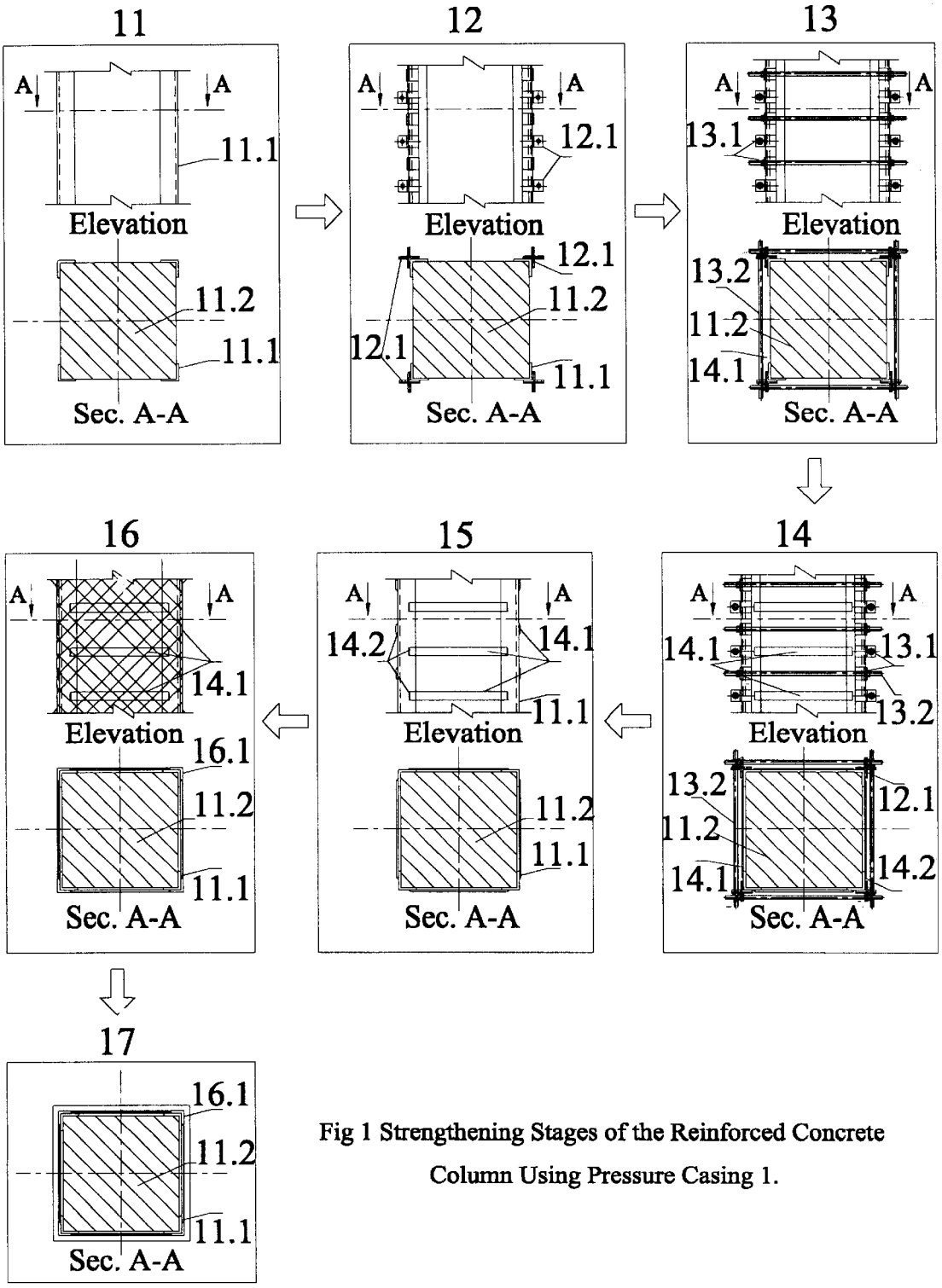
Fig 1 Strengthening Stages of the Reinforced Concrete Column Using Pressure Casing 1.

Figure 2A:
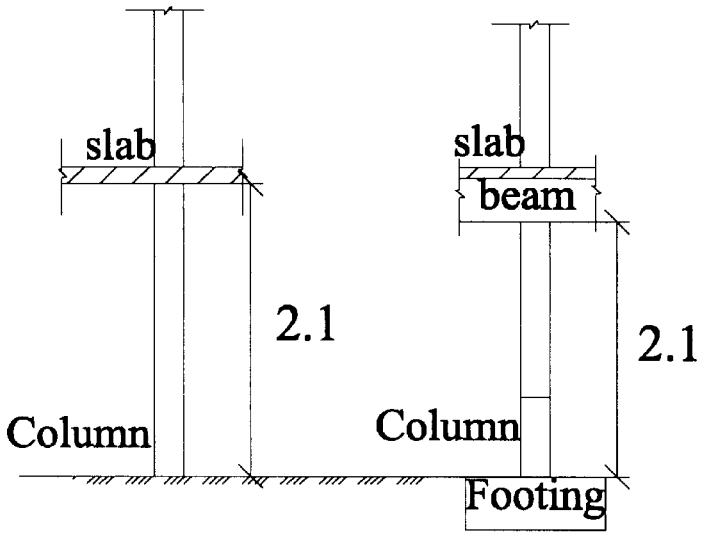
Figure 2B:
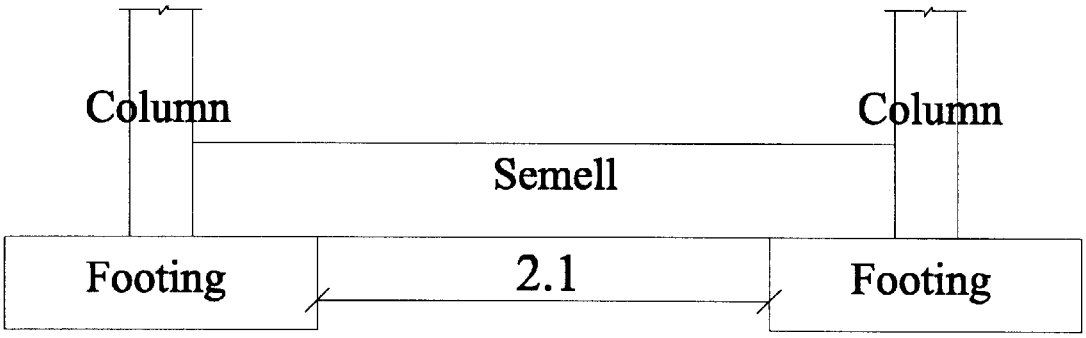
Figure 2C:
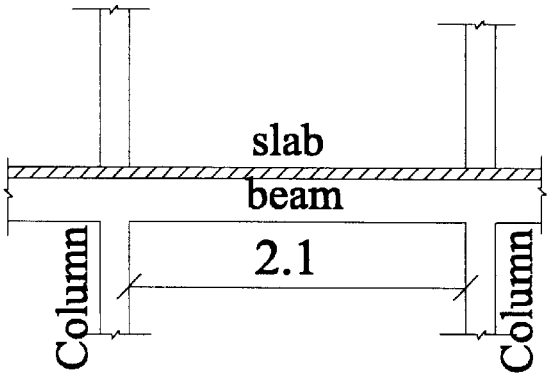

Fig 2A to 2C Definitions of Element Free Length

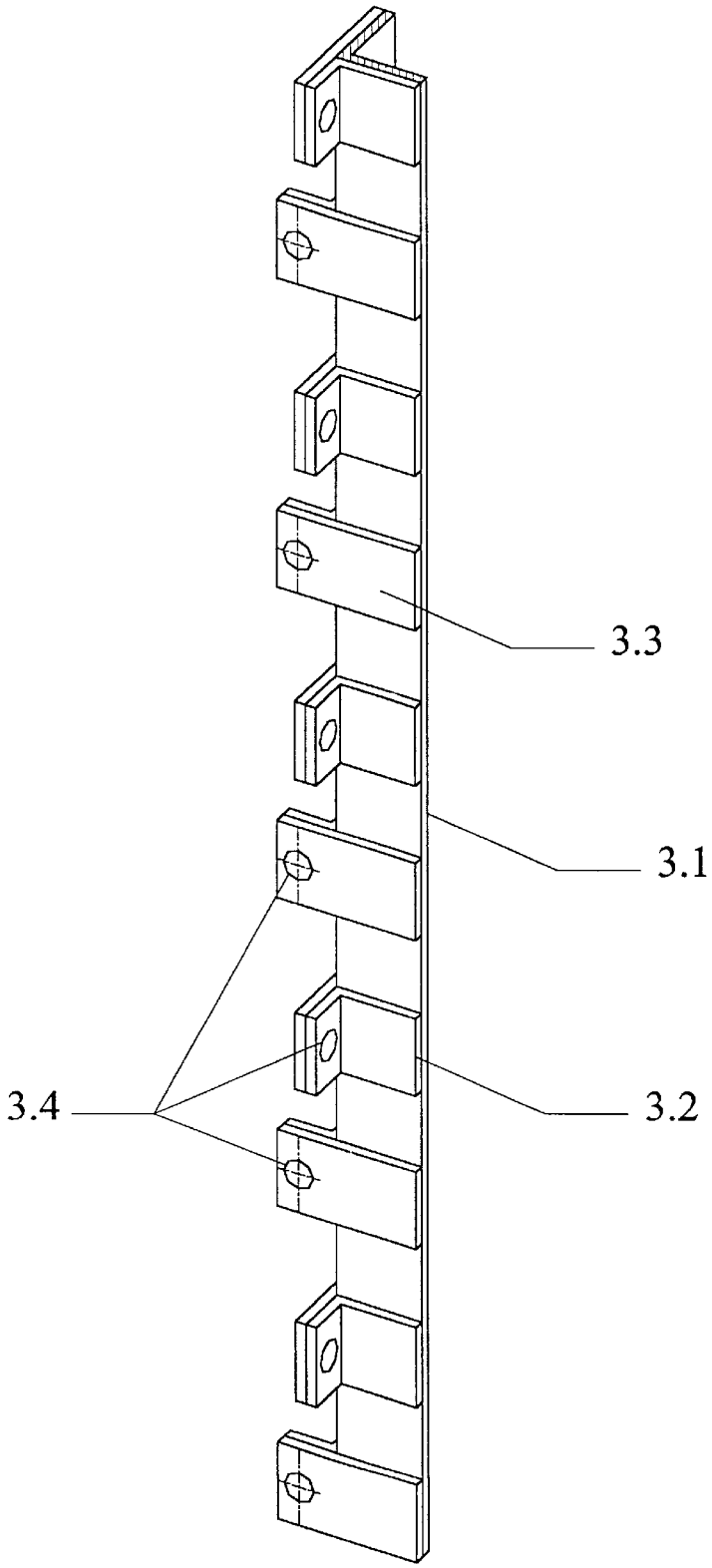
Fig 3 Typical Isometric View of One Edge in the Pressure Casing 1.

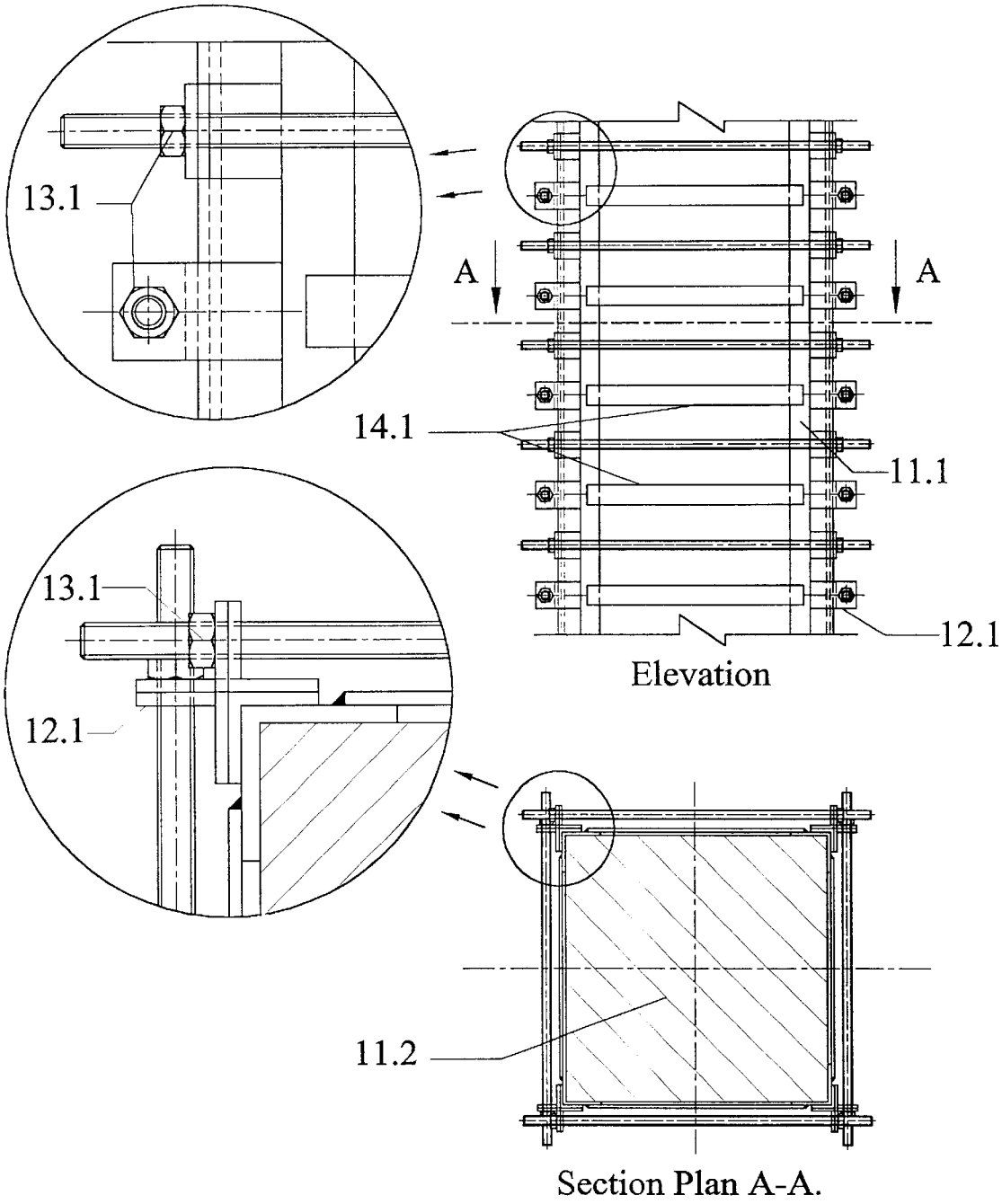
Fig 4 An Elevation and Section of a Column After Applying the confining pressure and before untied the Pressure Casing 1

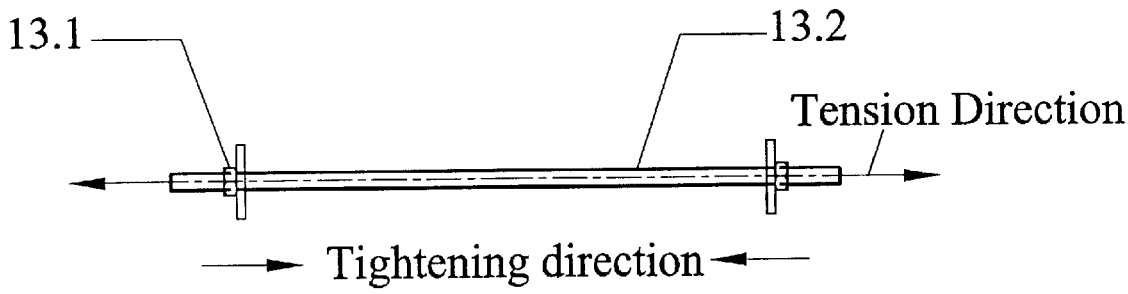
Fig 5 Direction of Tightening and Tensile Force in the Threaded Bar

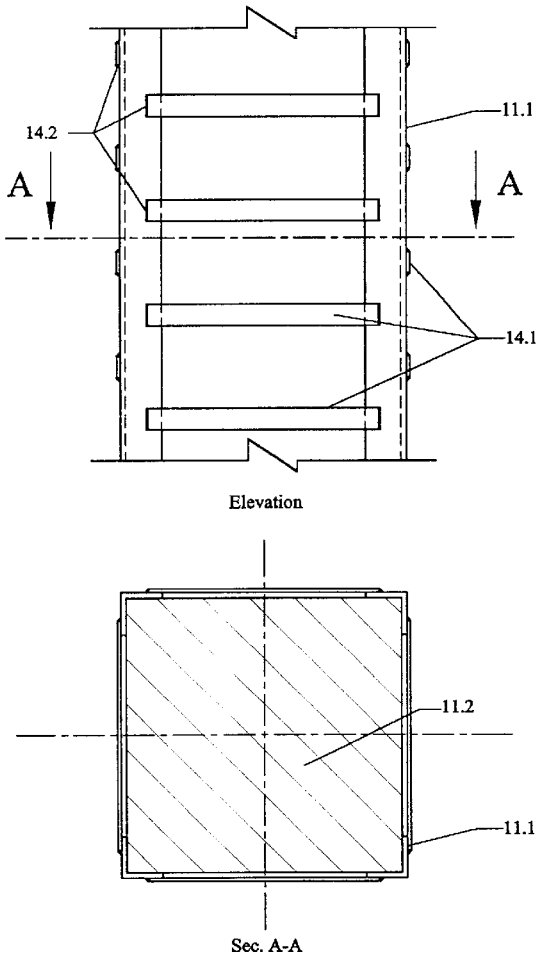
Fig 6 An Elevation and Section of Strengthened Column After Removing the Pressure Casing.
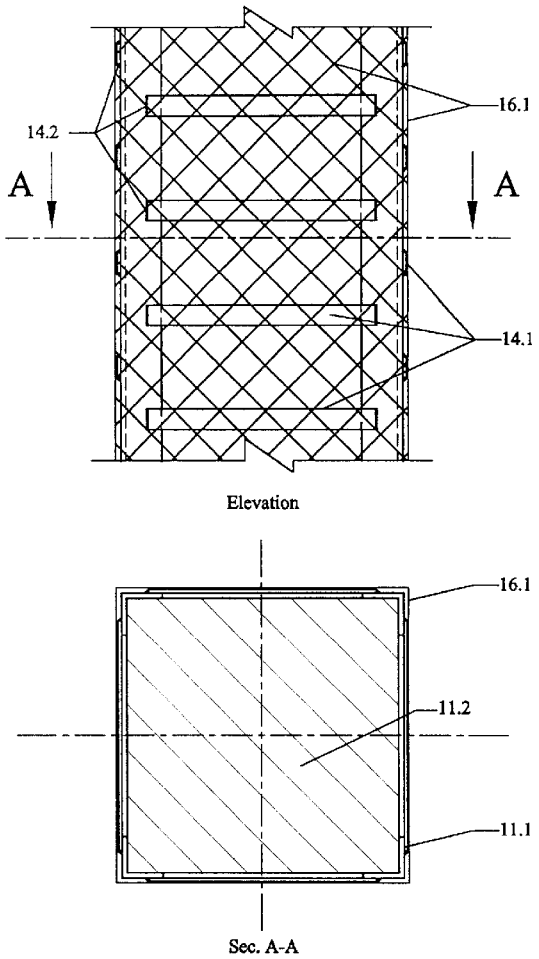
Fig 7 Wire Mesh Wrapped Around the Element

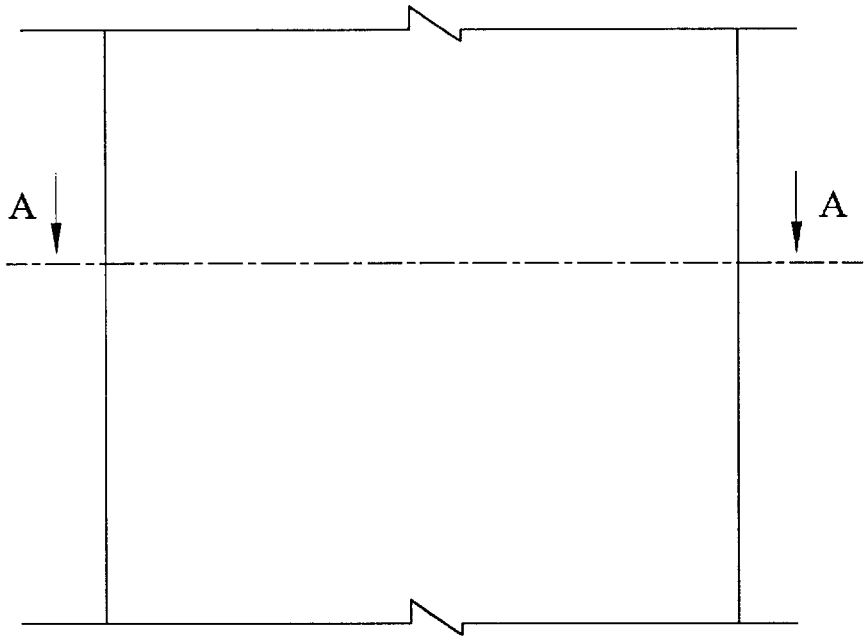
Elevation
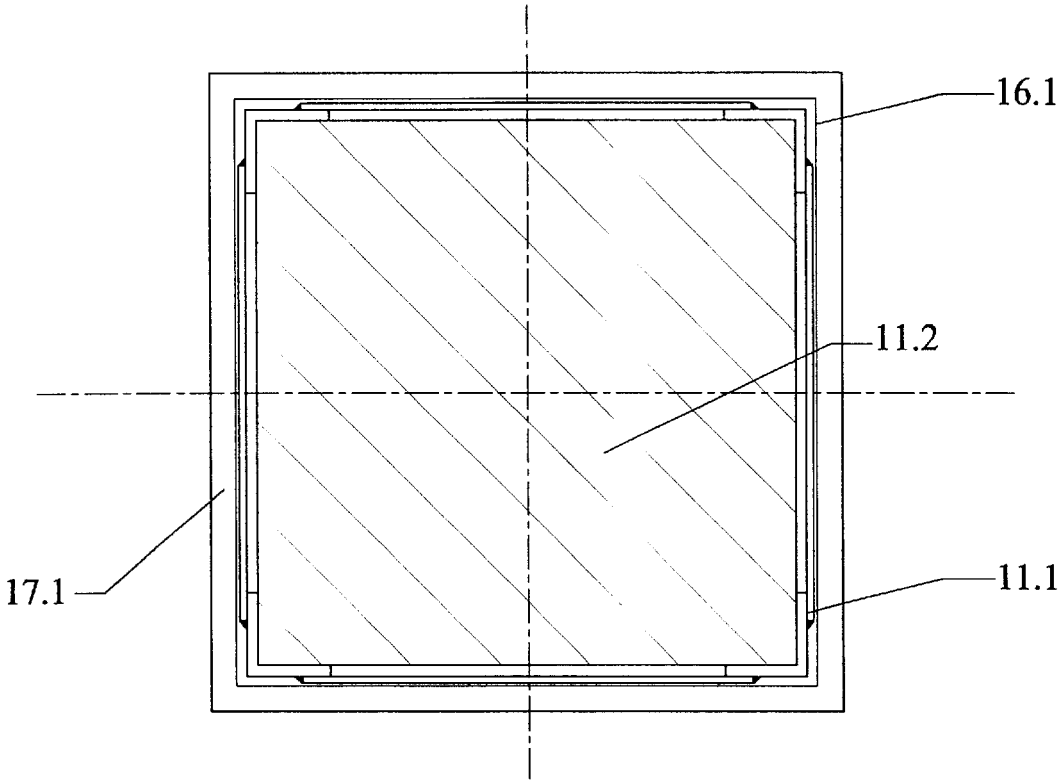
Sec. A-A
Fig 8 An Elevation and Section of a Column After the Strengthening Process Has Completely Finished by adding the plaster.

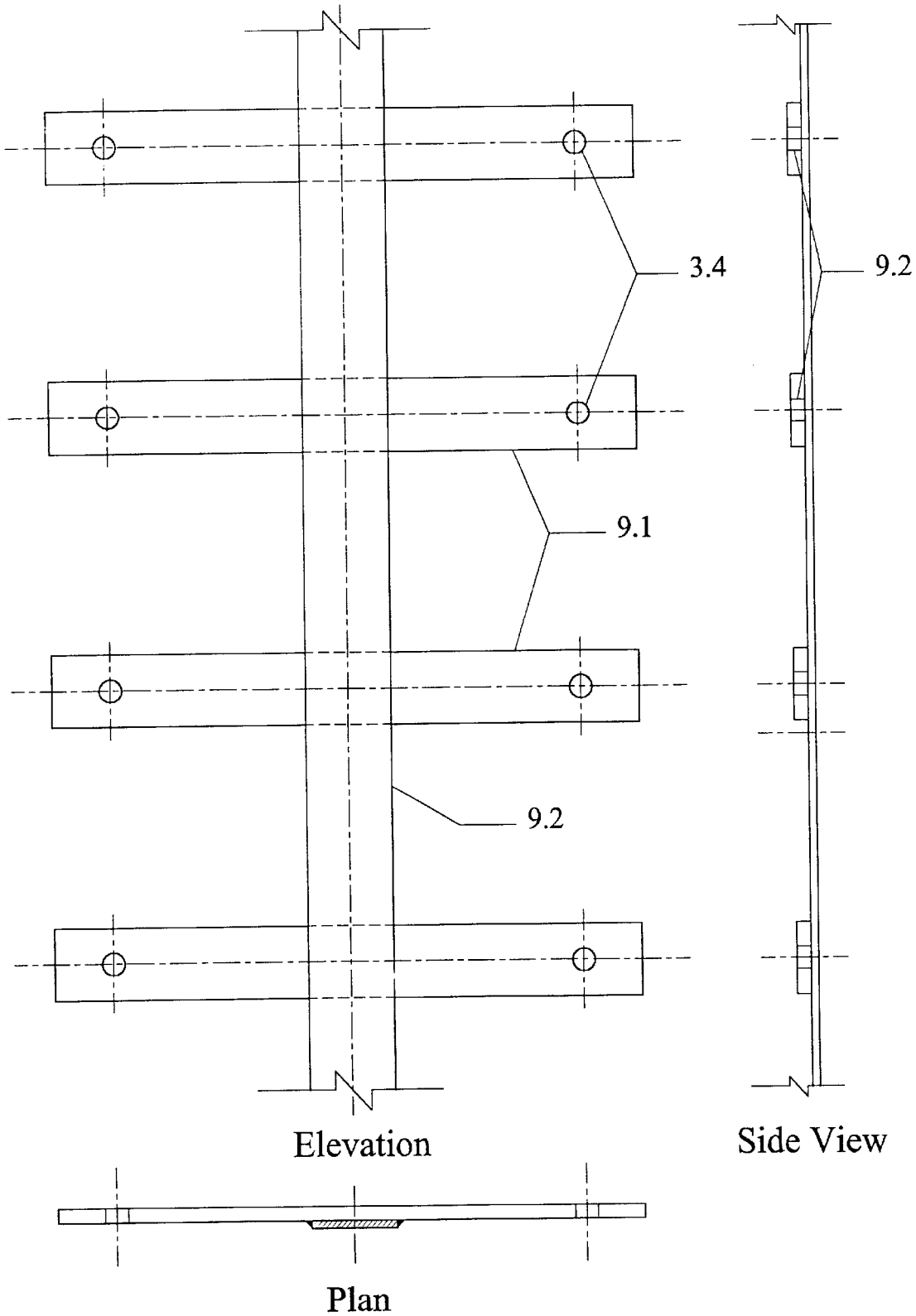
Fig 9 An Elevation, Plan and Side View
Of The Pressure Casing 2.

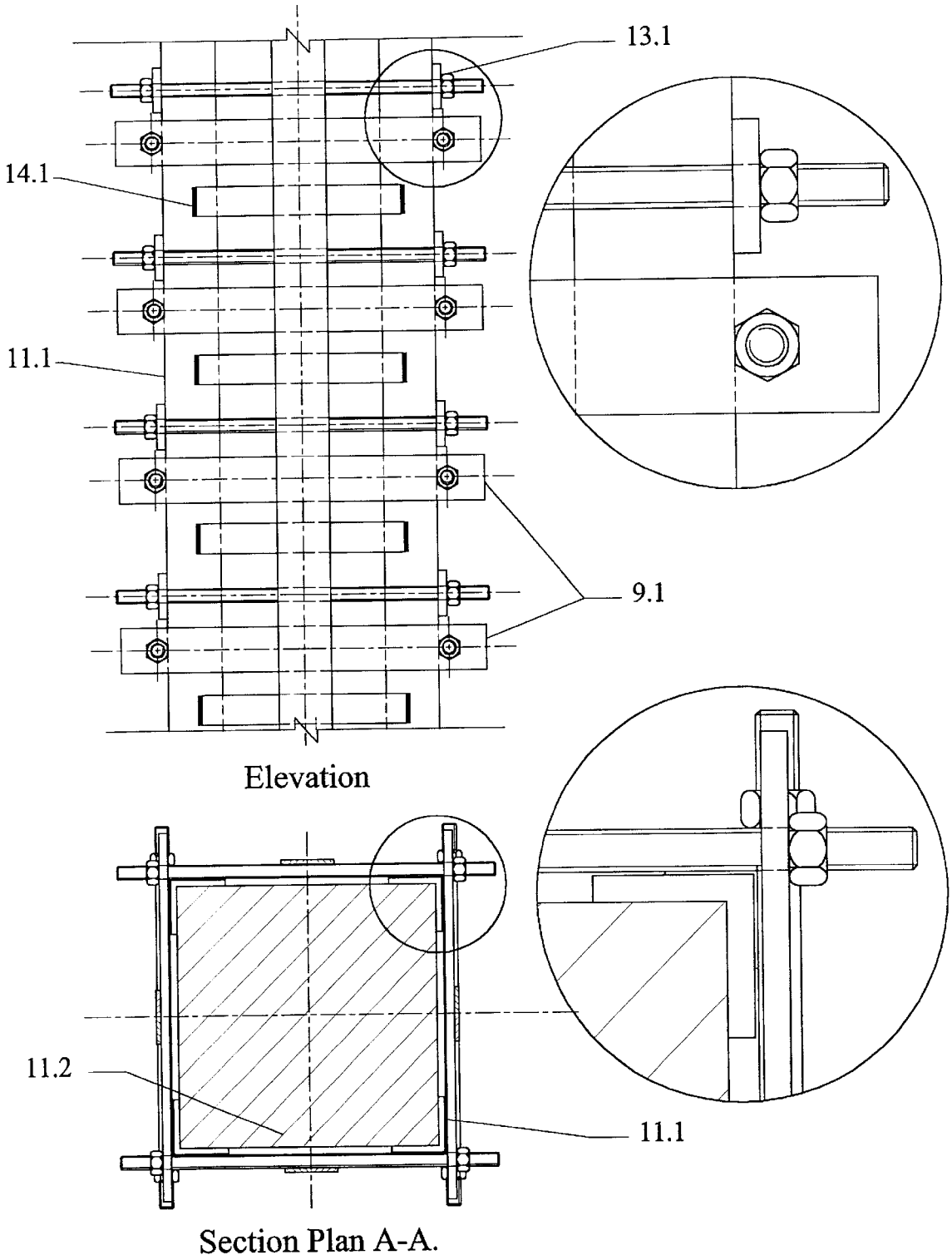
Fig 10 An Elevation and a Section of a Column After Appling Confining Pressure Uesing the Pressure Casing 2.

METHOD AND APPARATUS FOR STRENGTHENING THE CONCRETE ELEMENTS USING PRESTRESSING CONFINEMENT

BACKGROUND

1. Field of Invention

This invention relates to strengthening the reinforced concrete elements to increases the elements static and dynamic load capacities, and its ductility without significantly increasing the dimensions or weights of these elements, or even harming the concrete section. The invention also includes the apparatus used to apply the required confining pressure.

BACKGROUND

2. Description of Prior Art

Various techniques are available for strengthening the structural elements whether by making steel or concrete jacketing or in the case of columns by encompassing the existing reinforced concrete section with masonry blocks or strengthening it by either carbon or glass fiber reinforced plastic reinforcement. Through surveying these techniques, some undesirable effects have been found. Summary of these techniques with its disadvantages are presented herein:

1) Concrete Jacketing

Concrete jacketing has been widely used in repairing, strengthening, and improving the ductility capacity of damaged and existing reinforced concrete columns. But this technique increases dimensions of the structural element to an undesirable extent. The extra weight resulting from the concrete jacketing may lead to problems in foundations and the underlying soils. In addition, concrete jacketing is not suitable for strengthening in high rise buildings.

2) Steel Jacketing

Circular and rectangular steel jacketing are usually used to increase the flexural strength, ductility, and shear capacity of a part in the column. However, this technique mainly provides some local strength capacity increase. It also needs special equipment, besides assembling the steel jacket without post-tensioning it on the reinforced concrete member. Therefore, the clearance between the steel jacket and the reinforced concrete element permits internal strains to take place in the original reinforced concrete section.

3) Masonry Block Jacketing Similar to the concrete jacketing method, a masonry block jacket can be used for repairing and strengthening of existing and damaged columns. The undesirable effects are mainly the increase in dimensions and the additional over loads added to the existing reinforced concrete columns. Besides, this technique is only used in low to medium rise reinforced concrete buildings.

4) Partial Masonry Infill

This technique have been used for increasing the stiffness and strength of structures to control story displacements from high wind loads and other natural forces including seismic loads. An architectural disadvantage of using an infill wall retrofit for an existing building is the loss of space and access near the wall, along with adding more loads to the reinforced concrete buildings.

5) Strengthening the Reinforced Concrete Elements Using Either Carbon or Glass Fiber Reinforced Plastic Reinforcement This technique has been used for increasing the stiffness and strength of structural elements like columns, beams, and slabs. The main disadvantage of this technique arises when the strengthened element is subjected to a high temperature at which the strengthening material and epoxy used to bond them lose a great part of their strength. One more disadvantage is the brittle behavior of either carbon or glass fiber reinforced plastic materials, which decreases the ductility of the strengthened reinforced concrete element. At high loads, just before failure, the concrete cover is spilled away with these strengthening materials resulting in a sudden failure in the element.

Al-Tuhami and Sakr 1998, suggested an idea to strengthen the reinforced concrete columns. Their idea hypothesizes include making grooves in the original reinforced concrete cover to embed longitudinal bars with Epoxy bond materials between new steel bars and concrete. Then attach pre-stressed spiral or tied stirrups around the column. Finally adding cement mortar to cover the new bars and stirrups. The disadvantages of this idea are the harming of the original reinforced concrete section that arises from making grooves in the concrete cover which can lead to compression failure of the column. In addition the authors did not define how they can attach the pre-stressed spiral or tied stirrups to the concrete section.

U.S. patent application Ser. No. 07/646,288 to Fyfe (1991) disclose a limited method to improve the strength of a concrete column, supporting an overhead load and having a base end resting on a surface, using stretchable fibers. The fibers overwrapped about the surface of the column. Then applying a coat of hardenable material over the layer of the fibers. Afterwards a quantity of a hardenable liquid is injected under the layer of the fibers and over the surface of the work area to cause the fibers to undergo more stretching. The main disadvantage arises when the strengthened element is subjected to a high temperature at which the strengthening material and epoxy used to bond them lose a great part of their strength. In addition, this technique is limited to certain column configurations.

U.S. patent application Ser. No. 07/036,101 to Creedon (1988) shows a complex method for forming prestressed concrete members using casing disposed around the outside surface of the concrete member and is spaced therefrom so that a cavity is formed between the casing and the outside surface of the concrete member. Then a pressurized medium is injected into the cavity between the casing and the concrete member with predetermined pressure. It can be seen that, this technique needs complex apparatus, beside the difficulty of using this method to strengthen the existing concrete members especially for non-circular shaped cross-sections.

OBJECTS AND ADVANTAGES

Accordingly, several objects and advantages of my strengthening technique are:

1. It can avoids large dimensions of the strengthened elements compared with other techniques like reinforced concrete and masonry block jackets, which saves more space.
2. The increase of column weight in the present method is so small compared with weights added in case of using concrete or masonry jackets.
3. The method provide increases the static load capacity for existing reinforced concrete elements which is the aim of the most available strengthening techniques.
4. One important object of the present technique is to increase the seismic durability of the reinforced concrete elements especially columns, i.e. the strength of column against long term shaking will increased which cannot be achieved using either carbon or glass fiber reinforced plastic reinforcement methods during strong shaking.

5. It provides a very simple strengthening process and can be carried out so quickly.
6. Another object of the present method is to reduce the strengthening and repairing costs.
7. The present method can solve the problems of discontinuities in connections resulting from concrete, masonry block jacketing, and partial masonry infill techniques.
8—By the invention, the achieved strength of the reinforced concrete strengthened element is attained instantly and does not require the setting time needed in case of reinforced concrete jacket.

Further objects and advantages of my invention will become apparent from a consideration of the drawings and ensuing description.

DRAWING FIGURES

FIG. 1 Strengthening Stages of a Reinforced Concrete Column Using Pressure Casing 1.

FIG. 2A to 2C Definition of element free length.

FIG. 3 typical isometric view of one edge in the pressure casing 1.

FIG. 4 An elevation and a section of a column after applying confining pressure and adding the splices using the pressure casing 1.

FIG. 5 Direction of tying and the tensile force in the threaded bar.

FIG. 6 An elevation and a section of a column after removing the pressure casing.

FIG. 7 An elevation and a section of a column while a wire mesh wrapped around it.

FIG. 8 An elevation and a section of a column after the strengthening process has completely finished by adding the plaster.

FIG. 9 An elevation, plan and a side view of a pressure ca.

FIG. 10 An elevation and a section of a column during the process of applying confining pressure using the pressure casing 2.

REFERENCE NUMERALS IN DRAWINGS

11.1 four angles
11.2 the element to be strengthened
12.1 the pressure casing 1
13.1 nuts
13.2 threaded bars
14.1 splices
14.2 welding
16.1 wire mesh
17.1 plaster
2.1 free length of the element
3.1 main angle of the pressure casing 1
3.2 piece of angle
3.3 piece of plate
3.4 holes
8.1 plates
9.2 a thin plate

DESCRIPTION OF THE PREFERRED EMBODIMENT

Typical strengthening stages using pressure casing 1 are illustrated in FIG. 1. A stage 11 of the strengthening process is to erect four side angles 11.1, which are cut and placed, on the corners of the element to be strengthened 11.2. Stage 12 in FIG. 1 shows an elevation and a cross-section after placing the pressure casing 12.1 over the four side angles 11.1. The threaded bars 13.2 are then inserted in their positions and tightened with nuts 13.1 as illustrated in stage 13. In stage 14 FIG. 1, splices 14.1 are carefully cut and welded between the four side angles 11.1. Therefore the pressure casing 12.1 is untied and removed as shown in stage 15. Then the strengthened element 11.2 is warped with a wire mesh 16.1 as shown in stage 16 of FIG. 1. Plastering 17.1 is made to complete the Strengthening process of the reinforced concrete element.

In stage 11, FIG. 1, the underlain angle 11.1 is cut at the beginning of the process with a length equals to the free length of the element. Typical examples of what are mean by free length 2.1 are illustrated in FIG. 2A (free length of columns), FIG. 2.B (free length of a suspended semell) and FIG. 2C (free length of a beam).

The Pressure Casing 1

The pressure casing 1 consists of four main edge parts. Each part is named a main casing angle 12.1. A typical isometric view of one edge of the main casing angle and its component are illustrated in FIG. 3. Pieces of angles and plates, with holes in one side are carefully cut and welded on the back of the main angle 3.1 to be used in the pressure casing 1. The main angle 3.1 and a piece of angle 3.2 are welded in a back to back arrangement. Then a piece of plate 3.3, having the same width as the piece of angle 3.2, is welded on the back of the two angles 3.1 and 3.2. It should be noted that the hole centers in the piece of plate 3.3 and the piece of angle 3.2 should be coincident. The length of the plate piece 3.3 is equal to the lengths of the two legs of the main angle 3.1 and angle 3.2. The same procedure is repeated along the length of the main angle but in a staggered arrangement, as shown in FIG. 3.

FIG. 4 shows an elevation and a section of a column during the process of applying confining pressure. It shows the pressure casing 1 with its components as described above, the concrete section 11.2 of the element to be strengthened, and other four angles 11.1. It should be noted that the angle leg length in the pressure casing 12.1 must be smaller than that of the underlain four angles 11.1.

Parts of the embodiments are shown in FIGS. 6 and 7. FIG. 6 shows an elevation of a column after the process of applying confining pressure. Pieces of steel plates 14.1 are carefully cut and welded between every two angles from the underlain four angles 11.1 before the pressure casing being untied. FIG. 7 shows a wrapped wire mat 16.1 around a column before the final step in the strengthening process. FIG. 8 shows an elevation and a cross-section of a column after adding the plaster material 17.1 to the strengthened column.

The Pressure Casing 2

Another configuration of the pressure casing are illustrated in FIGS. 9 and 10. FIG. 9 show one side of the pressure casing two. A number of plates 9.1 having two open holes 9.2 on each, are welded at equal distances on a long thin plate 9.3, as shown in FIG. 9. This group of plates constitute only one side of the pressure casing 2. The pressure casing 2 consists of four sides of such group of plates shown in FIG. 10. Each two parallel sides are typical. As shown in FIG. 10, an elevation and a section of a column after applying the confining pressure and fixing the splices 14.1 between the underlain angles 11.1.

Operation

The technique is based on applying uniform distributed pressure around and along the length of the element, or the required part of it, to be strengthened. This confining pressure is sustained around the element by one of the following methods:

The First Method:

The first method can be summarized by the following procedures:

1—Four steel angles with equal lengths are cut with a length equal to the free length of the element to be strengthened. FIGS. 2A to 2C shows what the free length of the element means in column, semell and beam.

2—A pressure casing, consisting of four other steel angles with pieces of angles and plates is prepared for multiple use. The objective of this pressure casing with threading bars is to add the required pre-determined confining pressure to the concrete element.

Preparing the Pressure Casing 1:

Pieces of angles and plates, with holes in one side are carefully cut and welded on the back of the main angle 3.1 used in the pressure casing. The main angle 3.1 and a piece of angle 3.2 are welded in a back to back arrangement. Then a piece of plate 3.3 having the same width as the piece of angle 3.2 is welded on the back of the two angles 3.1 and 3.2. It should be noted that the hole center in the piece of plate 3.3 and the piece of angle 3.2 are coincident. The length of piece of plate 3.3 is equal to the length of webs of the main angle 3.1 and angle 3.2 web. The same procedure is repeated along the length of the main angle but in a staggered arrangement, as shown in FIG. 3. The above description forms one edge of the pressure casing 1. The pressure casing 1 consists of four edges as detailed above and shown in FIG. 3.

3—The pressure casing is assembled around the reinforced concrete element and the steel angles indicated in step number 1, by using threaded bars and two nuts for each threaded bar. The confining threaded bar and nuts is illustrated in FIG. 5. This figure also show the direction of tying and the resulting tensile force in the threaded bar.

4—The reinforced concrete element is then compressed with the four angles by turning the nuts inward and tensioning the threaded bars using wrench torque. This procedure is repeated for every threaded bar and by succession around the reinforced concrete element and downward. Adding pressure in the lower part of the column usually results in clearance between the reinforced concrete element and the confining system especially in the upper part. Therefore, another round of applying torque is needed until the required confining pressure is reached. FIG. 4 shows an elevation and a section of a column during the process of applying confining pressure.

5—Pieces of steel plates (splices) 14.1 are carefully cut and welded between the underlain four angles, prepared in step number 1, and placed on the corners of the element under the pressure casing. The plate pieces (splices) numbers, thickness, widths, welding areas, and the dimensions of underlain four angles 11.1 are chosen according to the required confining stress and consequently the required strength and ductility of the strengthened member.

It should be noted that the angle web widths in the pressure casing must be smaller than that of the underlain four angles 11.1 to allow for welding the splices with the underlain angles.

6—The pressure casing is then untied to be used in another element. FIG. 6, shows an elevation of strengthened column after removing the pressure casing, adding the required confining stress, and welding the pieces of plates. In FIG. 6, the four angles 11.1 which have been prepared in step number 1, splices 14.1 which have been welded after the process of pre-stressing, and the original reinforced concrete element 11.2.

7—To prepare the strengthened element for plastering and to cover the steel confining system, a wire mat is wrapped around the element, as shown in FIG. 7. In FIG. 7, the wire mat is indicated by number 16.1.

8—Finally we add cemenmortawchemical adhesive to cover the steel confining system and be used as plastering, at the same time. FIG. 8 shows an elevation and section of a column after the strengt-hening process has completely finished.

The Second Method:

This method has the same procedures as indicated in the first method, except for the pressure casing, which has different configurations. The pressure casing 2 is used in this method. The details of pressure casing 2 are described as follows:

1—A number of plates having two open holes 9.2 on each shown in FIG. 9, are welded at considerable distances between them, on a long thin plate 9.3. This group of plates and the thin one compose only one side of the pressure casing. A typical side is also prepared to be placed on the parallel side of the strengthened element.

2. Other number of plates are also welded on a thin plate at equal distances between them but shifted to be arranged in staggered manner on the perpendicular direction of the above mentioned sides.

3—The pressure casing 2 consists of four sides. Each two parallel sides are typical, as shown in FIG. 10.

The pressure casing 2 is assembled around the reinforced concrete element by the same procedures presented in method 1. As noted above, the only difference between the two methods is difference in the configuration of the two pressure casing. FIG. 10 shows an elevation and a section of a column during the process of applying confining pressure using pressure casing 2.

The advantages of this method over the previous one are that:

The second method is preferred in small-scale elements, like experimental models.

The second method also gives more area for welding the pieces of plates with the underlain four angles laying on the corners of the strengthened element, which may be required when high confining stress are needed. One shortcoming of this method compared to the first one is that the achieved confinement stress in the first method are more uniformly distributed along the length of the strengthened element.

Summary, Ramifications, and Scope

The reader will see that the technique presented in this invention provides a simple and effective method that can be used for strengthening the reinforced concrete columns with the following advantages:

1. The technique is very simple and can be carried out so quickly.
2. It reduces the strengthening and repairing costs.

3. It does not need complex technology to be carried out, therefore this method can be easily used in all countries.
4. Using this method avoids large dimensions of the reinforced concrete jacket, which saves more space.
5. The increase of column weight in the present technique is so small compared with weights added in case of using concrete or masonry jackets.
6. It does not harm the original reinforced concrete element during the strengthening operation.
7. The method increases the static axial load capacity for whole existing reinforced concrete elements or part of it, like columns, suspended semells, and beams. The expected increase in the element strength can be measured as a percentage of the distributed confining stress.
8. This technique increases the seismic durability and ductility of the reinforced concrete elements especially columns, to undergo large inelastic cyclic deformations, i.e. the strength of column against long term shaking is increased.
9. It reduces the transverse strains uniformly along the strengthened element.
10. It can solve the problems of discontinuities in connections resulting from concrete, masonry block jacketing, and partial masonry infill techniques.
11. This method can be used for strengthening the high rise reinforced concrete buildings.
12. By the new method, the possibility of making openings beside the column directly under the slab or the beams becomes easier.
13. The problems of local failure resulting from loading test can be avoided through partially confining the upper and the lower parts of the tested specimen by using the present technique.
14—The achieved strength of the reinforced concrete strengthened element is attained instantly and does not require the setting time needed in the case of reinforced concrete jacket.
15—By using this technique on the original reinforced concrete section to be strengthened together with concrete or masonry jackets when the stiffness of the strengthened element needs to be increased, it protects the core of the new section from internal stresses and strains.

Although the description above contains many specificities, these should not be construed as limiting the scope of the invention but as merely providing illustrations of some of the presently preferred embodiments of this invention. For example, the invention can cover the strengthening the suspended semelles, beams, beam-column connections, repairing the reinforced concrete elements, strengthening the stone columns and using the technique with the traditional strengthening methods as follows:

The proposed technique can be applied in strengthening the suspended semelles since its section is very similar to that of the column. The only difference between them is the direction of the long side which vertical in columns and horizontal in semelles.

By some modifications of the above-mentioned technique, the reinforced concrete beams can be strengthened.

The technique can be used successfully in repairing the reinforced concrete elements. In case of the existence of some cracks in the concrete element, the cracks are first injected with epoxy bond materials with a simultaneous pressure on the concrete element by using the above mentioned technique. Afterwards, the steps listed above in method one are followed precisely.

In old and archeological building where stone columns are still in use, the method is the most effective strengthening technique.

Thus the scope of the invention should be determined by the appended claims and their legal equivalents, rather than by the embodiment illustrated.

I claim:

1. A method for retrofitting an existing concrete element by using an external lateral confining pressure for increasing load capacity and ductility of said existing concrete element comprising the steps of providing:

a. a plurality of elongated (members having sufficient length) members each having a sufficient length extending along the longitudinal direction of said existing concrete element and arranged around said existing concrete element to reinforce and transmit said external lateral confining pressure to said existing concrete element, b. means for applying said external lateral confining pressure is performed through said elongated members, c. means for sustaining permanently said external lateral confining pressure around said existing concrete element.

2. The method of claim 1, wherein said elongated members have a shape of angles when the cross-section of said existing concrete element is a rectangular.

3. The method of claim 1, wherein said external lateral confining pressure is applied by means of a pressure casing exerting confinement action on said existing concrete element.

4. The method of claim 1 wherein said sustaining said external lateral confining pressure, using a plurality of splices that carefully cut and fixed between said elongated members.

5. The method outlined in claim 1, is used for retrofitting and strengthening said element or a part of it.

* * * * *